United States Patent [19]

Eckert

[11] 4,246,713

[45] Jan. 27, 1981

[54] ILLUMINATED ADVERTISING DISPLAY DEVICE WITH CHANGING VISUAL EFFECTS

[75] Inventor: Ronald P. Eckert, Northbrook, Ill.

[73] Assignee: Thomas A. Schutz Co., Inc., Morton Grove, Ill.

[21] Appl. No.: 46,802

[22] Filed: Jun. 8, 1979

[51] Int. Cl.[3] ..... G09F 13/06; G09F 13/12

[52] U.S. Cl. ..... 40/437; 40/219; 40/476; 40/579; 40/582

[58] Field of Search ..... 40/436, 437, 452, 447, 40/476, 490, 491, 492, 219, 509, 511, 513, 579, 580, 582, 583

[56] References Cited

U.S. PATENT DOCUMENTS

| | | | |
|---|---|---|---|
| 1,172,360 | 2/1916 | Hildburgh | 40/437 |
| 2,221,887 | 11/1940 | White | 40/219 |
| 2,221,888 | 11/1940 | White | 40/219 |
| 3,160,975 | 12/1964 | Malina | 40/436 |
| 3,747,243 | 7/1973 | Schneider | 40/436 |
| 3,883,966 | 5/1975 | Ludwig | 40/476 |
| 3,961,434 | 6/1976 | Sampon | 40/437 |
| 4,005,538 | 1/1977 | Tung | 40/582 X |

*Primary Examiner*—John F. Pitrelli
*Assistant Examiner*—G. Lee Skillington
*Attorney, Agent, or Firm*—Wegner, Stellman, McCord, Wood & Dalton

[57] ABSTRACT

An illuminated advertising display device produces changing visual effects by placing a panel having a pattern of holes at the front of a light box with some of the holes defining alpha-numeric characters, and reciprocating behind the panel a shutter which has a pattern of transparent spots each of which registers with a hole in the panel at some point in the reciprocation of the shutter, with some of the spots registered simultaneously with all the holes that define the alpha-numeric characters. The panel has a forwardly facing reflective surface, and spaced forwardly of the panel is a light transmitting reflective sheet. If desired, the transparent spots may be tinted in several different colors.

9 Claims, 8 Drawing Figures

ILLUMINATED ADVERTISING DISPLAY DEVICE WITH CHANGING VISUAL EFFECTS

BACKGROUND OF THE INVENTION

Persons involved in the development of point of purchase advertising display devices are primarily concerned with the problem of continuing to develop new devices which provide attractive and eye-catching visual effects. Many point of purchase advertising display devices utilize a light box with two or more relatively shiftable parallel panels having patterns of light transmitting spots or holes which may provide a shifting visual effect by moving one of the panels relative to the other so that the transparent spots of one panel are moved in and out of register with the spots of the other panel.

Devices of the above described type may have random patterns of transparent spots which serve to catch the eye and thus bring attention to a fixed advertising message. Others combine such random spots with spots which are arranged to define alpha-numeric characters so that an advertising message may be visible during a part of each cycle of the movable panel.

Many patents have issued upon devices of the foregoing general type, and a typical U.S. Pat. No. is 1,172,360.

SUMMARY OF THE INVENTION

The principal object of the present invention is to provide an illuminated advertising display device for point of purchase use which provides unique and eye-catching visual effects which differ markedly from anything found in the prior art.

Another object of the invention is to provide such a device which is of relatively simple construction with a minimum number of moving parts.

The device of the present invention has a housing which is open at the front, a light source in the rear of the housing, a panel near the front of the housing which has a pattern of holes, and reciprocating behind the panel is a shutter which has a pattern of transparent spots each of which registers with a hole in the panel at some point in the reciprocation of the shutter.

One aspect of the invention which provides a unique visual effect is that the panel has a forwardly facing reflective surface. This, in itself, provides a visual effect not found in the prior art.

Also contributing to the unique visual effect is that the panel, whether or not it is provided with a reflective front surface, is positioned slightly to the rear of a light transmitting reflective sheet which preferably has a metallic appearance. The use of a light transmitting reflective sheet at the front of a display device of the present type also produces, by itself, a unique visual effect. Combining the two produces an illuminated advertising display device having a most unique appearance.

When the device is viewed from a slight angle, each spot of light appears as multiple, offset images set one behind the other with an impression that they hang in space.

By providing the upper portion of the panel with a random pattern of holes and the lower portion with holes defining alpha-numeric characters, and providing the shutter with a pattern of transparent spots each of which registers with a hole in the panel at some point in the reciprocation of the shutter, and causing some of the transparent spots to register simultaneously with all the holes that define the alpha-numeric characters, reciprocation of the shutter produces a twinkling light effect which is preferably enhanced by tinting the transparent spots in several different colors. As some of the transparent spots move into simultaneous registration with all the holes that define the alpha-numeric characters, the advertising message is picked out in several layers of points of light which have the effect of hanging in space, and at the same time all the holes in the random pattern may also be illuminated if the transparent spots are arranged to produce this result. As used in the specification and claims, the term "holes" is to be construed broadly enough to cover any light transmitting spot, whether that spot is actually open or is a transparent point in an opaque panel. Conversely, the term "transparent spots" is to be construed broadly enough to include holes. The device requires a fixed opaque panel which has a pattern of light transmitting spots, and a movable opaque shutter which also has a pattern of light transmitting spots. How the spots are made light transmitting is of little significance, although it is preferred that the spots on the shutter not be openings, because it is easier to tint a transparent film surface than an opening.

The total visual effect of the most preferred form of the device actually cannot be illustrated in a drawing and cannot be adequately described.

THE DRAWINGS

DETAILED DESCRIPTION OF THE INVENTION

Figures 1, 2, 3:
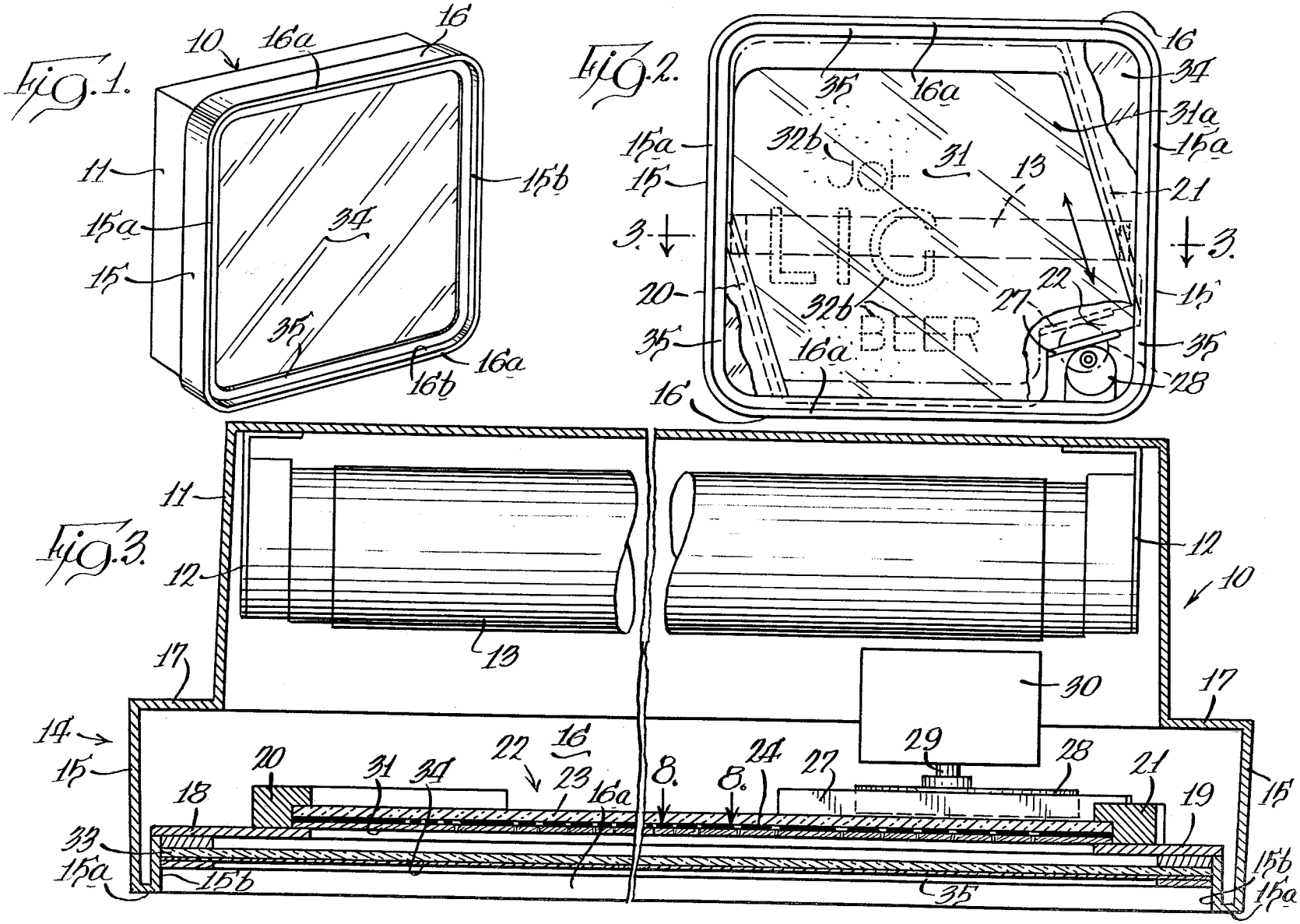
FIG. 1 is a perspective view of a display of the type which may embody the invention.
FIG. 2 is a front elevational view of a display embodying the invention, with parts broken away to illustrate the mechanism.
FIG. 3 is a horizontal section on an enlarged scale taken along the line 3—3 of FIG. 2.

Referring to the drawings in detail, the apparatus of the invention consists of a housing, indicated generally at 10, which includes a rearward portion 11 containing sockets 12 for fluorescent tubes 13; and a forward portion, indicated generally at 14, which is seen in FIGS. 1 and 2 to present the general appearance of a square frame with rounded corners. The frame-like forward portion 14 of the housing has side walls 15 and top and bottom walls 16 at the rear of which are transverse connecting webs 17 which connect them to the rearward portion 11 of the housing. At the front of the walls 15 and 16 are respective in-turned forward marginal portions **15*a* and 16*a* at the inner periphery of which are respective rearwardly extending webs 15*b* and 16*b*** that form a supporting frame for various elements of the display apparatus.

Figure 5:
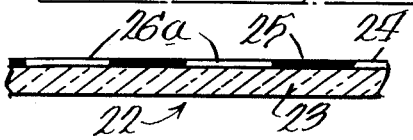
FIG. 5 is a fragmentary section on an enlarged scale taken along the line 5—5 of FIG. 4.
Figure 7:
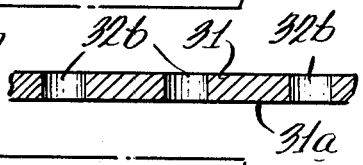
FIG. 7 is a fragmentary section on an enlarged scale taken substantially along the line 7—7 of FIG. 6.
Figure 6:
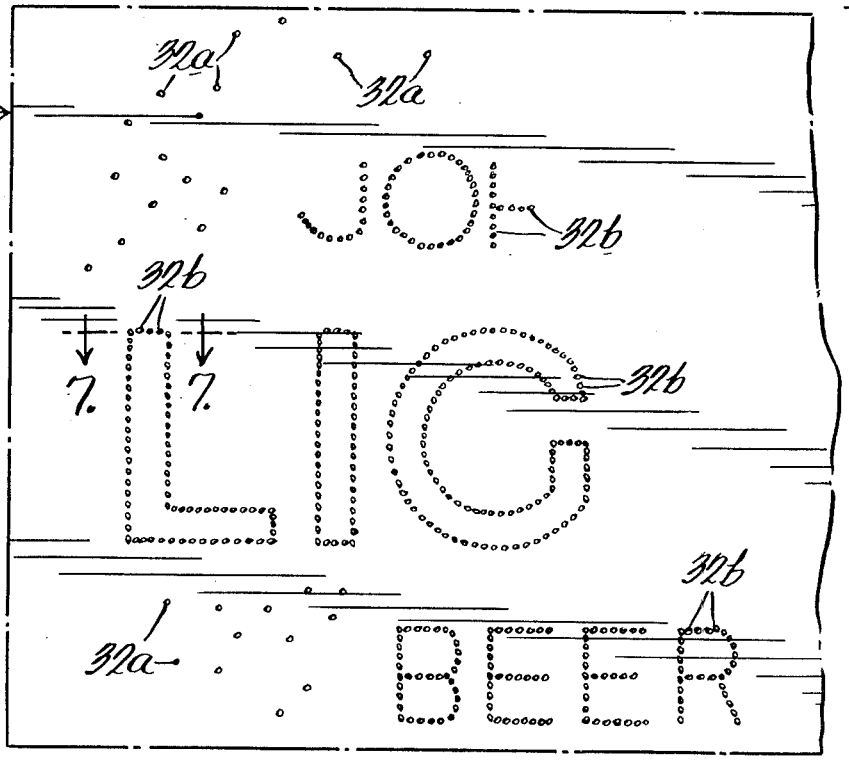
FIG. 6 is a fragmentary front elevation of an opaque panel matching the shutter of FIG. 4.
Figure 8:
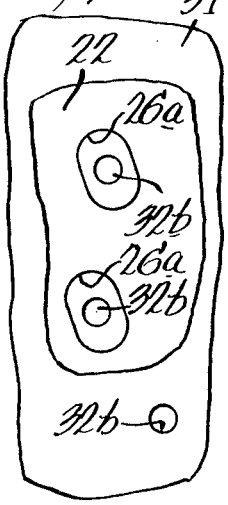
FIG. 8 is a fragmentary section on an enlarged scale taken along the line 8—8 of FIG. 3.

At the rear of the webs **15*b* are transversely extending, integral bracket members 18 and 19; and there are similar integral bracket members (not shown) at the top of the forward portion 14 of the housing. The integral bracket members support parallel, L-shaped rails 20 and 21 which cooperate to form a guideway that is seen in FIG. 2 to be inclined at an angle of about 15° or 20° to the vertical; and carried in the guideway is a movable shutter, indicated generally at 22, which consists of a rigid, transparent plate 23 to the front of which is bonded a film 24 which is principally opaque as seen at 25 in FIG. 5, but which has a pattern of transparent spots 26. Preferably the transparent spots 26** are tinted in a variety of contrasting colors.

At the bottom of the side of the shutter 22 which is near the guide rail 21 is a rearwardly extending flange 27 which seats upon a cam 28 that is mounted upon the shaft 29 of an electric motor 30. Energization of the motor 30 causes the cam 28 to rotate and thus reciprocate the shutter 22 between the guide rails 20 and 21 in the direction indicated by the arrows in FIGS. 2 and 4.

Forward of the shutter 22, and supported between the top and bottom walls 16 of the housing and the guide rails 20 and 21 is an opaque panel 31 which has a pattern of holes **32*a* and 32*b* formed in it. The holes 32*a* are in a random arrangement; while the holes 32*b* define any desired alpha-numeric characters. In a preferred embodiment of the invention the panel 31 has a highly reflective front surface 31*a* which may, for example, be provided by chromium plating a thin metal plate. The panel 31 provides the front of the guide rails 20 and 21, confining the shutter 22**.

Figure 4:
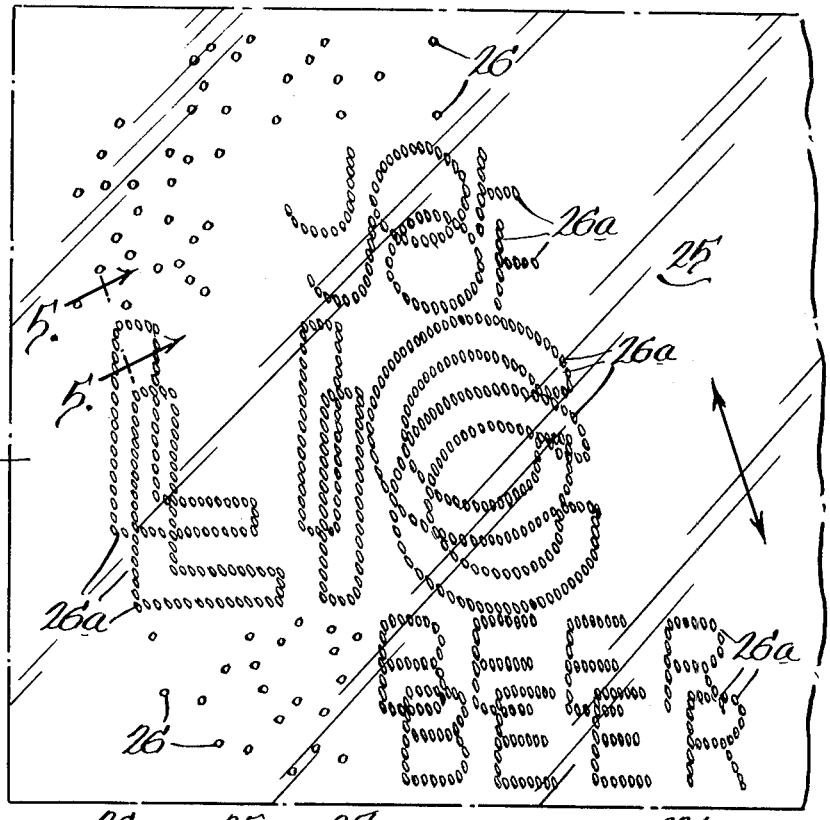
FIG. 4 is a fragmentary elevation of the shutter.

The pattern of transparent spots 26 in the shutter 22 is arranged to cooperate with the pattern of holes **32*a* and 32*b* of the panel 31, so that at some time during reciprocation of the shutter 22 each of the spots 26 registers with one or another of the holes 32*a* or 32*b* in the panel. Some of the spots 26, indicated in FIG. 4 as 26*a*, are arranged to form the same alpha-numeric characters as those defined by the holes 32*b* in the panel; and as seen in FIG. 4 there may be two sets of such transparent spots 26*a*. As the shutter 22 reciprocates, the transparent spots 26 and 26*a* move in and out of register with various of the holes 32*a* and 32*b* to provide a pattern of twinkling points of light of different colors. A lower group of the transparent spots 26*a* forming the alpha-numeric characters aligns with the holes 32*b* of the panel 31 when the shutter 22 is at the top of its reciprocatory motion; while an upper group of the transparent spots 26*a* aligns with the holes 32*b* when the shutter 22 is at the bottom of its reciprocatory motion. The effect of the display as described up to this point is to provide a reflection from the surface 31*a* of the panel 31 of whatever is opposite the panel, with the varicolored dots of light twinkling on and off in a random fashion and with the alpha-numeric characters picked out in brilliant spots of colored light twice in each cycle of the shutter 22**.

In order to eliminate the need for perfect registration of the transparent spots of the shutter with the holes in the panel, and also to somewhat extend the period during which light is visible through each of the holes **32*a* or 32*b*, the transparent spots 26 and 26*a* are made considerably larger than the holes. In addition, because the alpha-numeric characters constitute an advertising message the transparent spots 26*a* are elongated along an axis parallel to the arrow in FIG. 4. In a prototype the transparent spots 26 are 0.1 inch (2.54 mm) and the holes 32*a* and 32*b* are 0.05 inch (1.27 mm). The transparent spots 26*a* have a long axis of 0.15 inch (3.81 mm) with the short axis the same as the diameter of the spots 26**.

Referring again to FIG. 3, spaced forwardly from the panel 31 is a transparent plate 33 which is fixed in the frame formed by the webs **15*b* and 16*b*, and bonded to the front of the plate 33 is a light transmitting reflective sheet 34 of the type commonly known as a one-way window. Light transmitting reflective sheets 34** commonly consist of a relatively thin but substantially rigid transparent plastic sheet on one surface of which is a continuous metallic wash which is thin enough to transmit light. Commonly the wash is of a material which gives a gold cast to a reflection off the surface of the one-way window.

Finally, surrounding the one-way window 34 is an opaque frame 35 the outer periphery of which is bonded to the webs **15*b* and 16*b***.

The illumination through the transparent spots **26-26*a* and the holes 32*a*-32*b*, afforded by the fluorescent tubes 13, is sufficiently brilliant that the spots of multicolored light are clearly visible through the light transmitting reflective sheet 34. In addition, however, when the display is viewed from a slight angle it presents the appearance of several slightly angularly offset spots of light at different levels, principally due to the reflective surface 31*a* spaced a short distance behind the one-way window 34**. The overall visual effect is most unusual.

The foregoing detailed description has been given for clearness of understanding only and no unnecessary limitations should be understood therefrom as modifications will be obvious to those skilled in the art.

I claim:

1. An illuminated advertising display device comprising, in combination:

a housing which is open at the front;

a light source in the rear of said housing;

a panel which has a reflective surface facing the front of the housing, said panel having a pattern of tiny holes;

supporting means in said housing maintaining said panel in a fixed position;

parallel guideways operatively associated with said supporting means and extending upwardly from the lower part of the housing immediately behind the panel, said guideways having rear flanges in a plane parallel to said panel;

an opaque shutter which is mounted for reciprocating movement in said guideways and held against the panel by said rear flanges, said shutter having a pattern of transparent spots which are so arranged that each such spot registers with a hole in the panel at some point in the movement of the shutter, said spots being elongated in the direction of reciprocation of the shutter;

means for reciprocating said shutter to sequentially register different ones of said spots with said holes for periods of time that depend upon the rate of reciprocation of the shutter and the difference between the lengths of the transparent spots and the dimensions of the holes in the direction of elongation of said spots;

and a light transmitting reflective sheet fixed in the housing forward of the panel and in parallel, spaced relationship to said panel.

2. The combination of claim 1 in which some of the holes in the panel are arranged to define alpha-numeric characters, some of the spots on the shutter are positioned to register simultaneously with all the holes which define alpha-numeric characters, and some of the holes in the panel provide a random pattern of holes only some of which are in register with a spot on the shutter at any time, whereby the holes in said random pattern provide a visual effect of twinkling points of light as the shutter reciprocates.

3. The combination of claim 1 in which the means for moving the shutter comprises cam means in the bottom of the housing upon which the lower margin of the shutter is supported, and a motor to rotate said cam means.

4. The combination of claim 3 in which the guideways are inclined laterally a few degrees from the vertical so that one guideway partially supports the shutter, and the cam means comprises a single cam adjacent the other guideway providing the rest of the support for the shutter.

5. The combination of claim 1 in which the light transmitting reflective sheet has a metallic appearance.

6. The combination of claim 1 in which the transparent spots are tinted various colors.

7. An illuminated advertising display device comprising, in combination:

a housing which is open at the front;

a light source in the rear of said housing;

a panel adjacent the front of the housing, said panel having a pattern of holes;

an opaque shutter between the light source and said panel, said shutter being mounted for movement in a plane parallel to the panel and having a pattern of transparent spots which are so arranged that each such spot registers with a hole in the panel at some point in the movement of the shutter;

parallel guideways between which the shutter is mounted for reciprocating movement toward and away from the bottom of the housing, said guideways being inclined laterally a few degrees from the vertical so that one of said guideways provides part of the support for the shutter;

a single cam in the bottom of the housing adjacent the other of said guideways upon which the lower margin of the shutter rests, said single cam providing the remainder of the support for the shutter;

and a motor to rotate said cam means.

8. An illuminated advertising display device comprising, in combination:

a housing which is open at the front;

a light source in the rear of said housing;

a panel fixedly mounted in the housing and having a reflective surface facing the front of the housing, said panel having a pattern of tiny holes, some of said holes being arranged to define alpha-numeric characters and some of said holes providing a random pattern of holes;

parallel guideways mounted in the housing immediately behind the panel, said guideways extending upwardly from the lower part of the housing;

an opaque shutter which is mounted for reciprocating movement in said guideways in contact with the rear face of the panel, said shutter having a pattern of transparent spots which are elongated in the direction of reciprocation of the shutter, said spots being so arranged that each such spot registers with a hole in the panel at some point in the movement of the shutter, some of said spots being positioned to register simultaneously with all the holes which define alpha-numeric characters, and only a few of said spots being in register at any time with holes in said random pattern, whereby the holes in said random pattern provide a visual effect of twinkling points of light as the shutter reciprocates;

means for reciprocating said shutter to sequentially register different ones of said spots with said holes for periods of time that depend upon the rate of reciprocation of the shutter and the difference between the lengths of the transparent spots and the dimensions of the holes in the direction of elongation of said spots;

and a light transmitting relfective sheet fixed in the housing forward of the panel and in parallel, spaced relationship to said panel.

9. The combination of claim 8 in which the transparent spots are tinted various colors.

* * * * *